US010261434B2

(12) United States Patent
Fujita et al.

(10) Patent No.: US 10,261,434 B2
(45) Date of Patent: Apr. 16, 2019

(54) IMAGE FORMING APPARATUS WITH A POWDER SUPPLYING DEVICE AND AN IMAGE FORMING METHOD SUPPLYING POWDER TO A RESIN IMAGE

(71) Applicant: Konica Minolta, Inc., Tokyo (JP)

(72) Inventors: Michiyo Fujita, Hachioji (JP); Makoto Nomiya, Tokyo (JP); Tomomi Oshiba, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/976,102

(22) Filed: May 10, 2018

(65) Prior Publication Data

US 2018/0373175 A1 Dec. 27, 2018

(30) Foreign Application Priority Data

Jun. 22, 2017 (JP) ..... 2017-122368

(51) Int. Cl.

| | |
|---|---|
| ***G03G 15/20*** | (2006.01) |
| ***G03G 15/01*** | (2006.01) |
| ***G03G 15/08*** | (2006.01) |
| ***G03G 9/09*** | (2006.01) |

(52) U.S. Cl.

CPC ..... *G03G 15/01* (2013.01); *G03G 9/09* (2013.01); *G03G 15/08* (2013.01); *G03G 15/2064* (2013.01)

(58) Field of Classification Search

CPC ..... G03G 15/6585
USPC ..... 399/341
See application file for complete search history.

(56) References Cited

U.S. PATENT DOCUMENTS

| | | | | |
|---|---|---|---|---|
| 9,323,169 | B2 * | 4/2016 | Tyagi et al. ..... | G03G 15/6585 |
| 10,042,308 | B2 * | 8/2018 | Ron et al. ..... | G03G 15/6585 |

FOREIGN PATENT DOCUMENTS

| | | | |
|---|---|---|---|
| JP | H01200985 | A | 8/1989 |
| JP | 2013178452 | A | 9/2013 |
| JP | 2014157249 | A | 8/2014 |

* cited by examiner

*Primary Examiner* — William J Royer
(74) *Attorney, Agent, or Firm* — Lucas & Mercanti, LLP

(57) ABSTRACT

An image forming apparatus for forming an image by arranging powder on a surface of a layer of a resin image formed of a recording medium and a thermoplastic resin layer arranged thereon, includes: a powder supplying device that supplies the powder to the surface of the layer of the resin image; a hardware processor that sets a rubbing condition of the resin image in accordance with an image to be formed; and a rubbing device that rubs the resin image, which is adjusted to a temperature at which the layer of the resin image is softened or higher to which the powder is supplied from a side of the layer of the resin image according to the set rubbing condition.

15 Claims, 4 Drawing Sheets

IMAGE FORMING APPARATUS WITH A POWDER SUPPLYING DEVICE AND AN IMAGE FORMING METHOD SUPPLYING POWDER TO A RESIN IMAGE

The entire disclosure of Japanese patent Application No. 2017-122368, filed on Jun. 22, 2017, is incorporated herein by reference in its entirety.

BACKGROUND

Technological Field

The present invention relates to an image forming apparatus and an image forming method.

Description of the Related Art

In recent years, demands for special color printing and high-value added printing is increasing in the on-demand printing market. Above all, demands for metallic printing and pearl printing are particularly large, and various studies are being conducted.

As one of such methods, a method of transferring a metal foil and a resin foil by utilizing toner as an adhesive layer is studied; for example, a method of forming a toner image and bonding a transfer foil only to a toner portion is known (for example, refer to JP 01-200985 A). This method has a problem that when the foil is transferred to only a part of the image, all the remaining foil is wasted.

In contrast, studies to add a glittering pigment to the toner are also made. For example, a method is known in which a metallic image is formed only on a necessary portion by toner containing the glittering pigment (refer to, for example, JP 2014-157249 A). However, with this method, required metallic feeling and pearl feeling cannot be obtained in some cases.

As a further method, it is known to form a metallic image by attaching paint powder to the toner image (refer to, for example, JP 2013-178452 A). In this method, it is possible to obtain an image with high metallic feeling, but it is difficult to obtain a mirror-tone or pearl-tone image.

SUMMARY

An object of the present invention is to provide a novel technology of forming images having a desired appearance from a mirror tone or pearl tone to a glitter tone or from a gloss tone to a mat tone at a desired site.

To achieve the abovementioned object, according to an aspect of the present invention, there is provided an image forming apparatus for forming an image by arranging powder on a surface of a resin image formed of a recording medium and a thermoplastic resin layer arranged thereon, and the image forming apparatus reflecting one aspect of the present invention comprises: a powder supplying device that supplies the powder to the surface of the layer of the resin image; a hardware processor that sets a rubbing condition of the resin image in accordance with an image to be formed; and a rubbing device that rubs the resin image temperature of which is adjusted to temperature at which the layer is softened or higher to which the powder is supplied from the layer side according to the set rubbing condition.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1A:
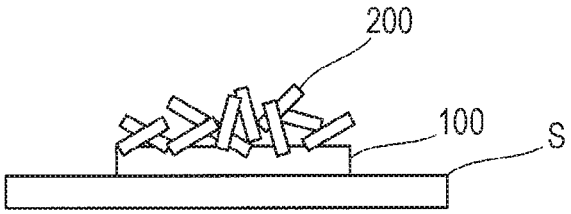
FIG. 1A is a view schematically illustrating a state of powder supplied onto a toner layer before rubbing.

Hereinafter, one or more embodiments of the present invention will be described with reference to the drawings. However, the scope of the invention is not limited to the disclosed embodiments.

An image forming apparatus of this embodiment is an image forming apparatus for forming an image by arranging a powder on a surface of a resin image.

The above resin image is formed of a recording medium and a thermoplastic resin layer arranged thereon. In the above resin image, at the time of supplying the above powder, the above layer is fixed on the recording medium. As described later, the resin image may be preferably fabricated by an electrophotographic image forming method, but a method of fabricating the resin image is not limited to this fabricating method.

The above recording medium may be appropriately selected out of objects capable of supporting the above layer and usually has a sheet-like shape, but its shape is not limited. Examples of the recording medium include plain paper from thin paper to thick paper, high quality paper, coated printing paper such as art paper and coated paper, commercially available Japanese paper and postcard paper, a plastic film, and cloth. A color of the above recording medium is not limited and may be appropriately determined according to a final image to be formed, for example.

The above thermoplastic resin may be appropriately selected out of various well-known resins having thermoplasticity, this may be of one type or more types, and examples thereof include styrene resin, (meta) acrylic resin, styrene-(meta) acrylic copolymer resin, vinyl resin such as olefin resin, polyester resin, polyamide resin, a carbonate resin, polyether, and polyvinyl acetate resin. Especially, the styrene resin, the acrylic resin, or the polyester resin are preferable.

The above resin image may be formed by a well-known image forming method such as dry and wet electrophotography or inkjet. Particularly, it is preferable that the above-resin image is formed by the electrophotography.

Temperature of the above resin image is adjusted to temperature at which the above layer softens or above (hereinafter also referred to as "rubbing temperature"). It is sufficient that the temperature of the above resin image is adjusted to the above rubbing temperature at least at the time of rubbing the surface by a rubbing device to be described later. The temperature of the above resin image may be adjusted by heating the resin image, or may be adjusted by cooling the heated resin image, or may be adjusted by keeping the heated resin image warm.

The above image forming apparatus includes a powder supplying device, the rubbing device, and a control device. The above powder supplying device is not limited as long as this may supply the above powder to the surface of the above layer of the above resin image. A well-known device may be used as the powder supplying device according to properties of the powder; for example, a powder supplying means disclosed in JP 2013-178452 A may be used as the powder supplying device.

The above rubbing device is the device for rubbing the above resin image supplied with the above powder from a side of the above layer. "Rubbing" means relatively moving with respect to the above layer along the surface while being in contact with the surface of the above layer on the recording medium. From a viewpoint of orienting the above powder on the surface of the above layer and strengthening bonding of the above powder to the above layer, the above rubbing is preferably accompanied with pressing. "Pressing" means pushing the surface of the above layer in a direction intersecting with the surface of the above layer (for example, perpendicularly).

In the above rubbing, if a relative speed of a rubbing portion in the rubbing device with respect to the above resin image is too slow, the orientation of the above powder along the surface of the above layer becomes insufficient, and if this is too fast, the above powder is sometimes insufficiently adhered and the orientation of the above powder along the surface of the above layer becomes insufficient, so that clarity of an intended appearance such as mirror tone and pearl tone in the final image might be deteriorated. From a viewpoint of sufficiently adhering and orienting the above powder on the surface of the above layer, the above relative speed is preferably 5 to 500 mm/sec.

In addition, in the above rubbing, if a contact width of the above rubbing portion on the surface of the above layer is too narrow, the orientation of the above powder is likely to vary when the above rubbing portion moves along the surface of the above layer, so that the orientation of the above powder adhering to the above layer might be insufficient, and if the above contact width is too wide, it becomes difficult to convey the recording medium. From a viewpoint of sufficiently realizing intended orientation of the above powder adhering to the surface of the above layer and conveyance properties of the recording medium, the above contact width is preferably set to 1 mm to 200 mm in a moving direction of the above rubbing portion with respect to the above resin image.

Also, if pressing force in the above pressing is too small, adherence strength of the above powder might be deteriorated, and if this is too large, the above layer itself might be disturbed, and torque at the time of conveying the resin image might become high. From a viewpoint of smooth realization and labor saving of the conveyance of the above resin image, from a viewpoint of holding the image formed on the above layer, and from a viewpoint of strengthening the adherence strength of the above powder, the above pressing force is preferably set to 1 to 30 kPa with respect to the surface of the above layer.

The above rubbing member and the above pressing member may be a rotating member or a non-rotating member such as a reciprocating member or a fixed member. The above rubbing member may be a member relatively movable with respect to the surface in a horizontal direction while being in contact with the surface of the above resin image having a horizontal surface and may be a rotatable roller which is in contact with the surface of the above resin image.

The above pressing member is configured such that a surface thereof is relatively movable with respect to the surface of the above layer while pressing the above resin image. The rubbing by the pressing member may be carried out, for example, by rubbing the resin image being conveyed with a fixed pressing member, or by rubbing the same with a roller rotating at a speed slower than a conveying speed of the resin image, or by rubbing the same with a roller rotating in a direction opposite to the conveying direction of the resin image, or by rubbing the same with a rotatable roller arranged in a direction in which a rotation axis thereof is oblique to the conveying direction of the resin image, or by rubbing the same with a member reciprocating on the surface of the resin image.

Therefore, it is sufficient that the above pressing member is configured to be movable in a direction relatively different from the above resin image while pressing the surface of the above layer.

Also, it is preferable that the above pressing member has flexibility. The flexibility of the pressing member is, for example, softness (deformation following property) such that the surface of the pressing member deforms to such a degree that this may follow a shape of the surface of the resin image at the time of pressing. Examples of the pressing member having such flexibility include a sponge and a brush.

The above control device is a device for setting a rubbing condition of the above resin image according to the image to be formed (final image). The above rubbing condition is a condition of determining a presence state of the above powder on the above layer by the above rubbing. Examples of the rubbing condition include the temperature (rubbing temperature) of the above resin image, the pressing force of the above pressing member against the above resin image, and the relative speed of the surface of the above rubbing member relatively moving with respect to the surface of the above layer of the above resin image (hereinafter, also referred to as a "rubbing speed"). The above rubbing condition includes the above rubbing temperature, and the above control device may set the rubbing condition based only on the above rubbing temperature, or may set the rubbing condition based on the above rubbing temperature and other rubbing conditions.

The above rubbing condition may be set by selecting an appropriate condition according to the image to be formed from data collected in advance regarding correspondence between various conditions under the above rubbing condition and the final images at that time, for example. The above data may be based on an experimental result of actually fabricating the final image under the various rubbing conditions or may be based on a calculation result by computer simulation. The above control device may be formed of an ordinary computer including, for example, an input unit, a control unit, a storage unit, a calculation unit, and an output unit.

Figure 1B:
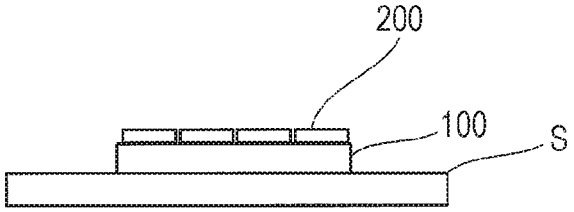
FIG. 1B is a view schematically illustrating a state of the powder on the toner layer after the rubbing at minimum rubbing temperature.

The above rubbing temperature is the temperature at which the above powder adheres to the above layer at the time of rubbing. At the time of rubbing, the above powder is randomly supplied onto the above layer as illustrated in FIG. 1A, for example. In a case where the temperature of the above resin image is the temperature at which the above layer exhibits adherence properties such that the powder adheres to the surface of the above layer (hereinafter also referred to as "minimum rubbing temperature"), as illustrated in FIG. 1B, the powder supplied on the surface of the above layer is oriented flatly by the rubbing as illustrated in FIG. 1B. As a result, an image having a mirror-tone, pearl-tone, or gloss-tone appearance is formed according to hue of the resin image and the type of the powder.

Figure 1C:
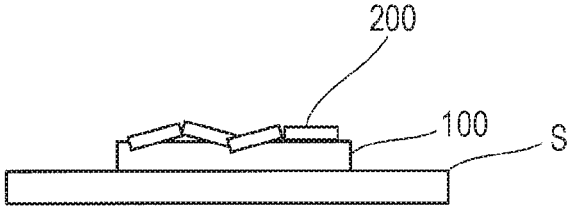
FIG. 1C is a view schematically illustrating a state of the powder on the toner layer after the rubbing at intermediate rubbing temperature.

In a case where the above rubbing temperature is higher than the above minimum rubbing temperature (hereinafter also referred to as "intermediate rubbing temperature"), the powder supplied to the surface of the above layer is rubbed to be spread in a planar direction and a part thereof is pushed into the above layer as illustrated in FIG. 1C. As a result, an image having an arbitrary appearance between the mirror tone and the pearl tone and a glitter tone is formed based on the hue of the resin image and the type of the powder, and further an amount or proportion of the powder pushed into the layer is formed, or an image having an appearance between the gloss tone and mat tone is formed.

Figure 1D:
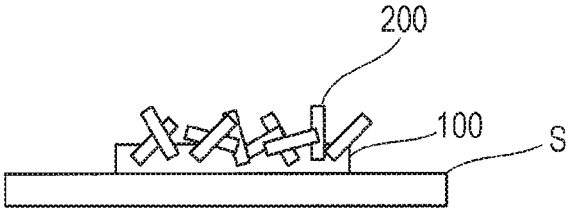
FIG. 1D is a view schematically illustrating the state of the powder on the toner layer after the rubbing at maximum rubbing temperature.

In a case where the above rubbing temperature is higher than the above intermediate rubbing temperature (hereinafter also referred to as "maximum rubbing temperature"), the powder supplied to the surface of the above layer is rubbed to be spread in a planar direction and a part thereof is pushed into the above layer as in the case in FIG. 1C, but the amount and proportion of the powder pushed into the above layer increase as illustrated in FIG. 1D. As a result, an image having a glitter-tone or mat-tone appearance is formed based on the hue of the resin image and the type of the powder.

When the temperature of the above resin image is higher than the above maximum rubbing temperature, the softening of the above layer further progresses, and the layer is shaved by rubbing, so that a normal final image cannot be obtained. Therefore, the above rubbing temperature may be determined to be from the temperature at which the above powder adheres to the surface of the above layer (minimum rubbing temperature) to the temperature at which the above layer does not collapse while the above powder is pushed into the above layer (maximum rubbing temperature).

The above rubbing temperature may be obtained by gradually increasing the temperature of the above resin image at room temperature, and detecting the temperature at which the intended image may be obtained, for example, the temperature at which the above powder starts to adhere to the surface of the above layer in the case of the mirror-tone image, and may be obtained by further raising the temperature and detecting the temperature at which the glitter-tone image may be obtained. More specifically, the above rubbing temperature may be determined by a method of heating a hot plate to predetermined temperature, placing the resin image thereon such that the above layer (image surface) faces upward, allowing the above powder which is wanted to be used to adhere to an appropriate application member, for example, a sponge of an eye shadow chip and rubbing the surface of the above layer lightly, and checking the adhesion of the above powder to the surface of the above layer and the pushing of the above powder into the above layer.

Each of the above-described minimum, intermediate and maximum rubbing temperatures may have an appropriate range, for example, a temperature range of 2 to 5° C. The above maximum rubbing temperature may be determined by the above-described method, but if this is the temperature within a range in which the above layer does not collapse due to the rubbing, it is also possible to determine as temperature sufficiently higher than the above minimum rubbing temperature, for example, the temperature higher than the above minimum rubbing temperature by 90° C. Also, the above intermediate rubbing temperature may be one (for example, a median value of the temperature range from the above minimum rubbing temperature to the above maximum rubbing temperature) or higher. For example, the above intermediate rubbing temperature may be a temperature value that equally divides the above temperature range, or may be specific temperature within the above temperature range according to the appearance of the image to be formed.

The above pressing force is a pressure on the above resin image of the above pressing member at the time of the above rubbing. The above pressing force may be determined, for example, by fabricating the final image while changing the pressing force at the above minimum rubbing temperature. The presence state of the above powder in the above layer becomes the state illustrated in FIG. 1B with small pressing force (minimum pressing force) including zero, and becomes the state illustrated in FIG. 1C, then FIG. 1D as the pressing force is increased.

The above rubbing speed may be determined, for example, by fabricating the final image while changing the rubbing speed at the above minimum rubbing temperature. For example, the presence state of the above powder in the above layer becomes the state illustrated in FIG. 1B at a low rubbing speed, and becomes the state illustrated in FIG. 1C, then FIG. 1D as the rubbing speed is increased.

The above powder is not limited. The above powder is supplied to the above layer of the above resin image under the rubbing condition described above and is rubbed to provide a special appearance corresponding to the hue of the powder and the resin image to the resin image. For example, the above powder may be spherical powder or non-spherical powder. Also, the above powder may be a synthetic product or a commercially available product. Furthermore, the above powder may be a mixture of particles of two or more different materials.

The above powder may be coated; for example, this may be metal powder a surface of which is coated with a metal oxide or resin, metal oxide powder a surface of which is coated with resin or metal, or resin powder a surface of which is coated with metal, a metal oxide, or resin.

The above non-spherical powder is powder other than the spherical powder. The spherical powder is powder with a cross-sectional shape or a projected shape having an average degree of circularity of 0.970 or greater. Meanwhile, the average degree of circularity may be obtained by a well-known method or this may be a catalog value.

It is preferable that the above non-spherical powder has a flat particle shape from a viewpoint of orienting to adhere the non-spherical powder along the surface of the above layer. The "flat particle shape" of the above non-spherical powder means a shape in which, assuming that a maximum length of the particle of the non-spherical powder is defined as a longer diameter, a maximum length in a direction orthogonal to the longer diameter is defined as a shorter diameter, and a minimum length in the direction orthogonal to the above longest diameter is defined as a thickness, a ratio of the shorter diameter to the thickness is 5 or larger.

The thickness of the above non-spherical powder is preferably set from 0.2 to 10 μm, and more preferably set from 0.2 to 3.0 μm, from a viewpoint of sufficiently expressing an appearance effect due to the oriented adhesion of the non-spherical powder. When the above thickness is too small, there is a case in which an excellent orientation state of the non-spherical powder in which the planar direction of the non-spherical powder including the above longer diameter direction and the above shorter diameter direction of the non-spherical powder adhered to the surface of the above layer is substantially along the surface direction of the above layer is not sufficiently formed. If the above thickness is too large, the powder might be removed when the image is rubbed.

The material of the above non-spherical powder is not limited. The non-spherical powder is preferably the metal powder or is preferably the metal oxide powder from a viewpoint of expressing the appearance from the pearl tone or mirror tone to the glitter tone as a desired appearance of the final image. The above non-spherical powder may be coated; for example, this may be the metal powder the surface of which is coated with the metal oxide or resin, the metal oxide powder the surface of which is coated with the resin or metal, or the resin powder the surface of which is coated with metal, the metal oxide, or the resin.

Examples of the non-spherical powder include Sunshine Babe Chrome Powder, Aurora Powder, and Pearl Powder (all manufactured by GG Corporation inc.), ICEGEL Mirror Metal Powder (manufactured by TAT inc.), Pica Ace MC Shine Dust and Effect C (manufactured by Kurachi inc., "Pica Ace" is the registered trademark of the company), PREGEL Magic Powder and Mirror Series (manufactured by Preanfa, Limited, "PREGEL" is the registered trademark of the company), Bonnail Shine Powder (manufactured by K's Planning, Inc., "BONNAIL" is the registered trademark of the company), METASHINE (Nippon Sheet Glass Co., Ltd, registered trademark of the company), ELgee neo (manufactured by OIKE & Co., Ltd., registered trademark of this company), and Astro flake (Nihonboshitsu Co., Ltd., registered trademark of Okazaki Hajime).

The above image forming apparatus may further have other configurations than the above powder supplying device and the rubbing device as long as the effect of this embodiment may be obtained. Examples of the other configurations include a temperature adjusting device, a powder recovery device, an image fabricator, and an image detecting device.

The above temperature adjusting device is a device for adjusting the temperature of the above resin image rubbed by the above rubbing device. The temperature adjusting device may be a heating device, a cooling device, or a device having both functions. A well-known device may be used as the temperature adjusting device, and examples of which include a hot plate, an oven, and a blower.

In a case where the above resin image is supplied to the above image forming apparatus in a state in which the temperature thereof is sufficiently higher than the above rubbing temperature, the temperature adjusting device may be a conveying device for conveying the resin image to the rubbing device through the powder supplying device at a speed at which the temperature of the resin image reaches the above rubbing temperature when this is conveyed to the above rubbing device or through such a route.

The above powder recovery device is a device for recovering the powder supplied to the surface of the above layer. From a viewpoint of preventing the final image from being contaminated by surplus powder and from a viewpoint of making it possible to reuse the powder, the above powder recovery device is preferably a device for recovering the powder remaining on the surface of the resin image after being rubbed by the rubbing device. Examples of the powder recovery device include an elastic member such as a sponge, a brush, and a blade which abuts the above surface, a suction device arranged so as to be opposed to the above surface, and a container for accommodating the surplus powder dropping from the above surface. The above powder recovery device may be the above pressing member in the above rubbing device.

The above image fabricator is a device for fabricating the above resin image. For example, a well-known electrophotographic image forming apparatus may be used as the image fabricator. Also, the above image detecting device is a device for detecting a specific appearance of the above powder such as the mirror tone in the final image. As the image detecting device, for example, a reflected light measuring device and a luster degree measuring device may be used. The image detection device may be connected to the above control device and the above control device may further include further control based on a detection value of the above image detection device, for example, feedback control in the setting of the rubbing condition.

The image forming method of this embodiment may be performed by the image forming method including a step of supplying the above powder to the surface of the above layer of the above resin image, a step of setting the rubbing condition of the above resin image according to the image to be formed, and a step of rubbing the above resin image of which temperature is adjusted to the above rubbing temperature according to the set rubbing condition supplied with the above powder from the above layer side. This image forming method may be carried out using the image forming apparatus of this embodiment described above.

The above image forming method may further include other steps than the above powder supplying step and rubbing step as long as the effect of this embodiment may be obtained. Examples of the other steps include a step of forming the above resin image, and a step of adjusting the temperature outside an intended range of the above resin image to temperature equal to or higher than the temperature at which the above layer is softened. The above step of forming the resin image may be performed by a normal electrophotographic image forming method. The above temperature adjusting step may be preferably performed using the above-described temperature adjusting device.

Hereinafter, this embodiment is further described with reference to the drawings. Hereinafter, a mode in which the image forming apparatus of this embodiment is added to an electrophotographic image forming apparatus as a surface treatment device is described.

Figure 2:
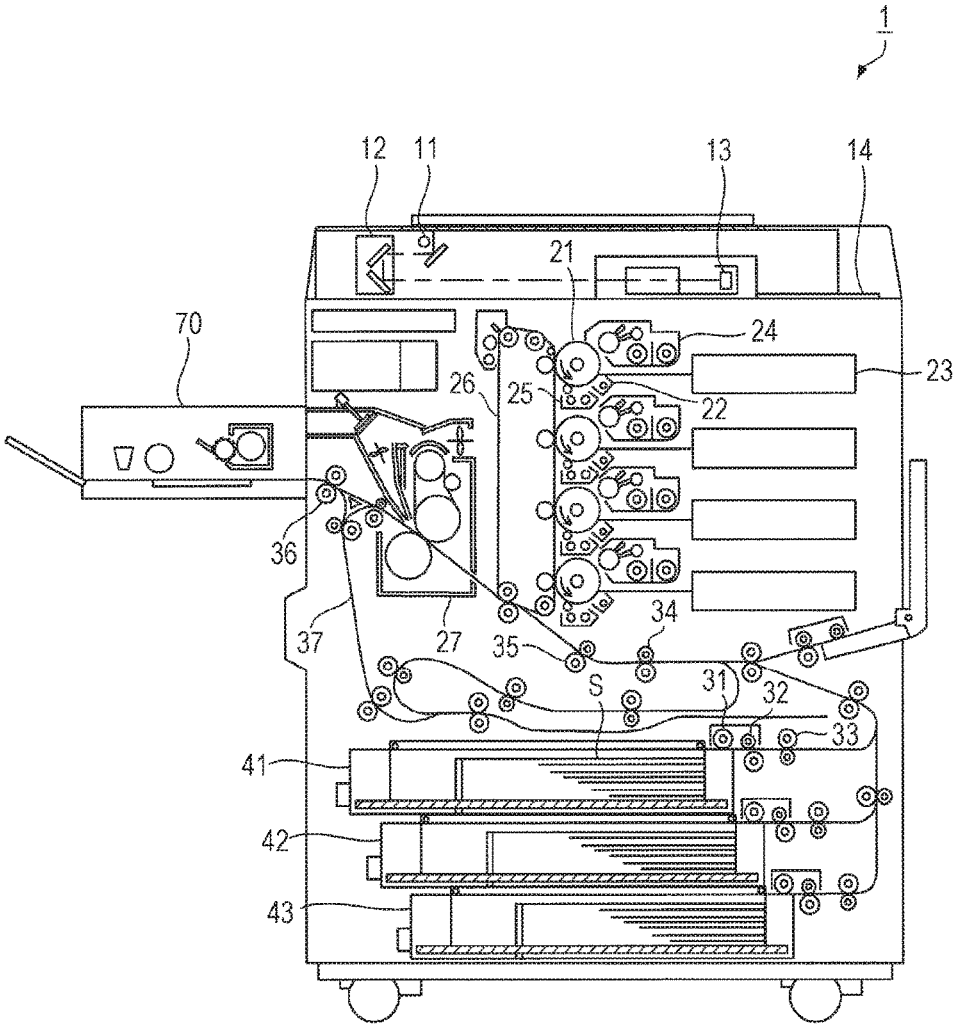
FIG. 2 is a view schematically illustrating a configuration of an image forming apparatus according to an embodiment of the present invention and an electrophotographic image forming system including the same.

As illustrated in FIG. 2, an image forming system 1 includes a toner image forming apparatus and a surface treatment device.

The toner image forming apparatus corresponds to the above-described image fabricator and has a configuration similar to that of a well-known color printer; the toner image forming apparatus includes, for example, an image reading unit, an image forming unit, a paper conveying unit, a paper feeding unit, a control unit, and a fixing unit 27. The control unit corresponds to the above-described control device.

The image reading unit includes a light source 11, an optical system 12, an imaging element 13, and an image processing unit 14.

The image forming unit includes an image forming unit which forms an image of yellow (Y) toner, an image forming unit which forms an image of magenta (M) toner, an image forming unit which forms an image of cyan (C) toner, an image forming unit which forms an image of black (K) toner, and an intermediate transfer belt 26. Meanwhile, Y, M, C, and K represent the colors of the toner.

The image forming unit includes a photoreceptor drum 21 as a rotating body, and a charging unit 22, an optical writing unit 23, a developing device 24, and a drum cleaner 25 arranged around the same. The intermediate transfer belt 26 is wound by a plurality of rollers and supported so as to be able to run.

The paper conveying unit is provided with a delivery roller 31, a separation roller 32, a conveying roller 33, a loop roller 34, a registration roller 35, a paper discharge roller 36, and a paper reversing unit 37. The paper feeding unit includes a plurality of paper feed trays 41, 42, and 43 that accommodate a paper S.

The control unit includes a central processing unit (CPU), a random access memory (RAM), and a read only memory (ROM). In accordance with a program stored in the ROM, the CPU controls the image reading unit, the image forming unit, the paper conveying unit, the paper feeding unit, and the surface treatment device, and stores a calculation result and the like in the RAM. In addition, the control unit performs control to analyze externally received print data, generate bit map image data, and to form an image based on the image data on the paper S. The above program includes a program for setting the rubbing condition in the above surface treatment device.

Figure 3:
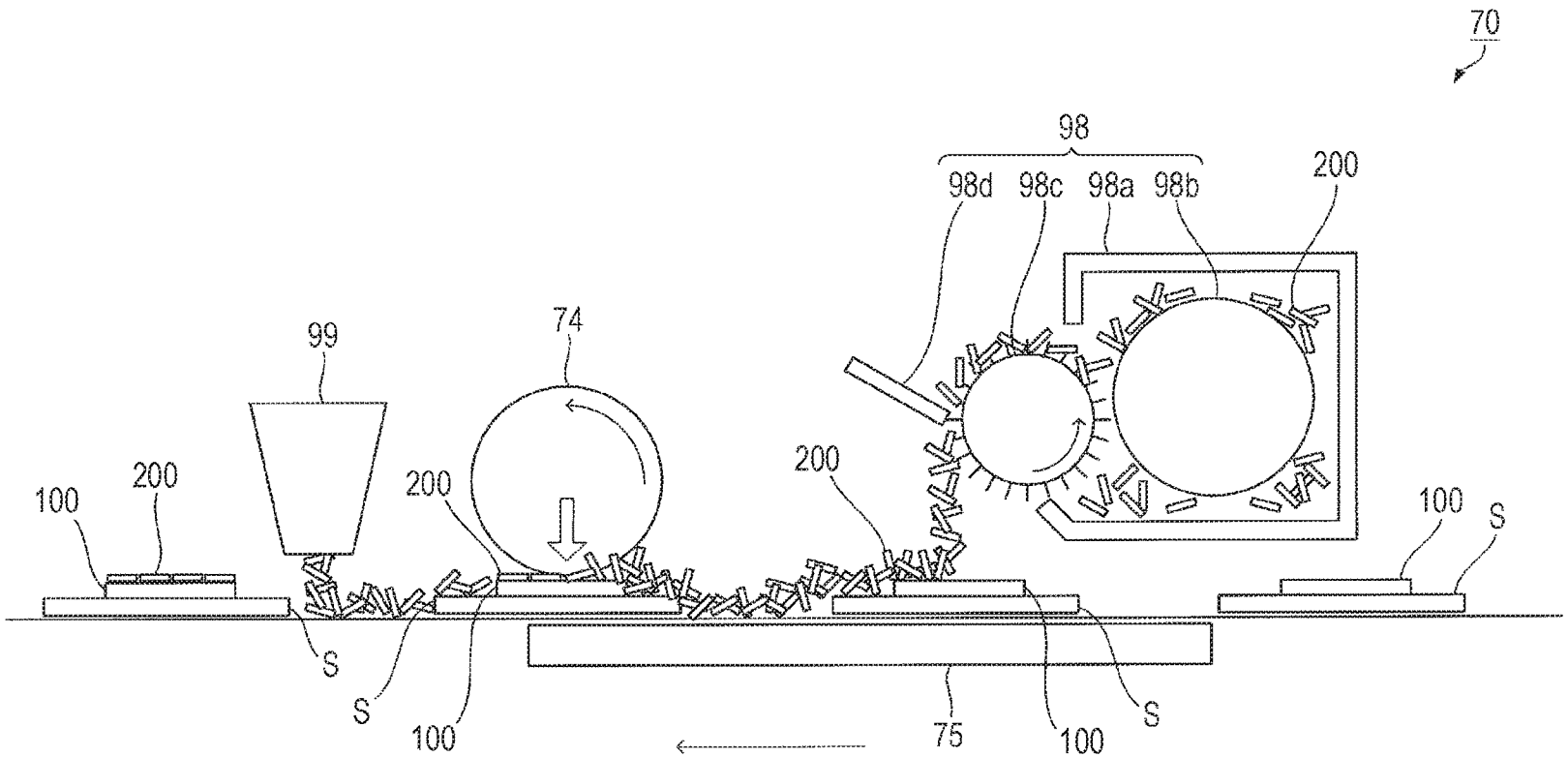
FIG. 3 is a view schematically illustrating a configuration of the above image forming apparatus.

The surface treatment device includes a powder supplying unit 70. As illustrated in FIG. 3, the powder supplying unit 70 includes a rubbing roller 74, a heater 75, a paint powder spraying unit 98, and a paint powder recovering unit 99.

The paint powder spraying unit 98 is a device for spraying powder 200 onto the paper S as a means of spraying the powder 200. The paint powder spraying unit 98 includes a container 98*a* for accommodating the powder 200, a conveying screw 98*b* for conveying the powder 200 to an opening of the container 98*a*, a brush roller 98*c* for taking out the powder 200 from the container 98*a*, and a flicker 98*d* for flicking the powder 200 held by the brush roller 98*c*. The powder 200 is the above-described non-spherical powder having the flat particle shape, for example.

In order to regulate an amount of the powder 200 held by the brush roller 98*c*, the opening of the container 98*a* is formed to have a size brought into contact with a tip of a brush of the brush roller 98*c*. The flicker 98*d* is a plate-shaped member and is arranged in a position where this comes into contact with the brush roller 98*c*. A biting amount of the flicker 98*d* into the brush roller 98*c* may be determined in consideration of, for example, a supply amount of the powder 200 and uneven wear of the brush, and a brush bristle length and brush density of the brush roller 98*c* may be determined, for example, in consideration of the supply amount of the powder 200 and dropping thereof.

The flicker 98*d* may be fixed at a position in contact with the brush roller 98*c*, but the flicker 98*d* may be configured to be movable so that the flicker 98*d* separates from the brush roller 98*c* when the brush roller 98*c* stops.

The rubbing roller 74 having a rotation axis in a direction perpendicular to the conveying direction of the paper S (direction perpendicular to the drawing) is configured to be rotatable in a direction of an arrow in the drawing, and to be biased by a biasing member (not illustrated). The rubbing roller 74 includes, for example, cylindrical core metal and an elastic layer such as a resin sponge arranged on an outer peripheral surface thereof. A length in an axial direction of the rubbing roller 74 is longer than a width of the paper S.

The heater 75 is provided in a position opposed to the rubbing roller 74. The heater 75 is, for example, a hot plate.

The paint powder recovering unit 99 is, for example, a powder collector for sucking surplus powder 200 out of the powder 200 supplied from the paint powder spraying unit 98. The powder collector is arranged so that a suction opening opens at a position at an appropriate height from a conveying path of the paper S, and this is configured, for example, to operate with an appropriate output to suck the powder 200 but not to suck the paper S.

In the image forming system 1, the control unit controls the image reading unit, the image forming unit, the paper conveying unit, the paper feeding unit, and the surface treatment device.

In the image reading unit, light applied from the light source 11 irradiates an original placed on a reading surface, and reflected light thereof forms an image on the imaging element 13 moved to a reading position through a lens and a reflecting mirror of the optical system 12. The imaging element 13 generates an electric signal according to intensity of the reflected light from an original. The generated electric signal is converted from an analog signal to a digital signal in the image processing unit 14, this is subjected to correction processing, filter processing, image compression processing and the like, and is stored as the image data in a memory of the image processing unit 14. In this manner, the image reading unit reads the image of the original and stores the image data.

In the image forming unit, the photoreceptor drum 21 rotates at a predetermined speed by a drum motor. The charging unit 22 charges a surface of the photoreceptor drum 21 to desired potential, and the optical writing unit 23 writes an image information signal on the photoreceptor drum 21 based on the image data, and forms a latent image based on the image information signal on the photoreceptor drum 21. Then, the latent image is developed by the developing device 24, and a toner image which is a visible image is formed on the photoreceptor drum 21. In this manner, unfixed toner images of yellow, magenta, cyan, and black are formed on the photoreceptor drums 21 of the image forming units of Y, M, C, and K, respectively. In this manner, the image forming unit forms the toner image using an electrophotographic image forming process.

The toner images of the respective colors formed by the respective image forming units of Y, M, C, and K are sequentially transferred onto the running intermediate transfer belt 26 by a primary transfer unit. In this manner, a color toner image in which toner layers of respective colors of yellow, magenta, cyan, and black are superimposed is formed on the intermediate transfer belt 26.

In the paper conveying unit, the paper S is delivered one by one from the paper feed trays 41, 42, and 43 of the paper feeding unit to a conveyance route by the delivering roller 31 and the separating roller 32. The paper S delivered to the conveyance route is conveyed by the conveyance roller 33 along the conveyance route to a secondary transfer roller via the loop roller 34 and the registration roller 35. Then, the color toner image on the intermediate transfer belt 26 is transferred to the paper S.

The paper S to which the color toner image is transferred is heated and pressurized by the fixing unit 27, so that the color toner image on the paper S is fixed to the paper S as a color toner layer. In this manner, a resin image 100 is fabricated on the paper S. The paper S having the resin image 100 is delivered to the surface treatment device via the paper discharge roller 36.

Meanwhile, it is possible to guide the paper S on which the fixing is performed to the paper reversing unit 37 to reverse the paper S and discharge the same. As a result, images may be formed on both sides of the paper S.

An example of control by the surface treatment device by the above control unit is described. In this example, the rubbing condition is selected at three steps, but this may be stepless (mode in which an arbitrary value between a minimum value and a maximum value of the set value is selected).

In the paint powder spraying unit 98, the powder 200 accommodated in the container 98*a* is conveyed to the brush roller 98*c* by the conveying screw 98*b*. The brush roller 98*c* rotates counterclockwise, for example, and captures the powder 200. The powder 200 captured by the brush roller 98*c* is flickered by the flicker 98*d* and sprayed onto the paper S and the resin image 100.

Figure 4:
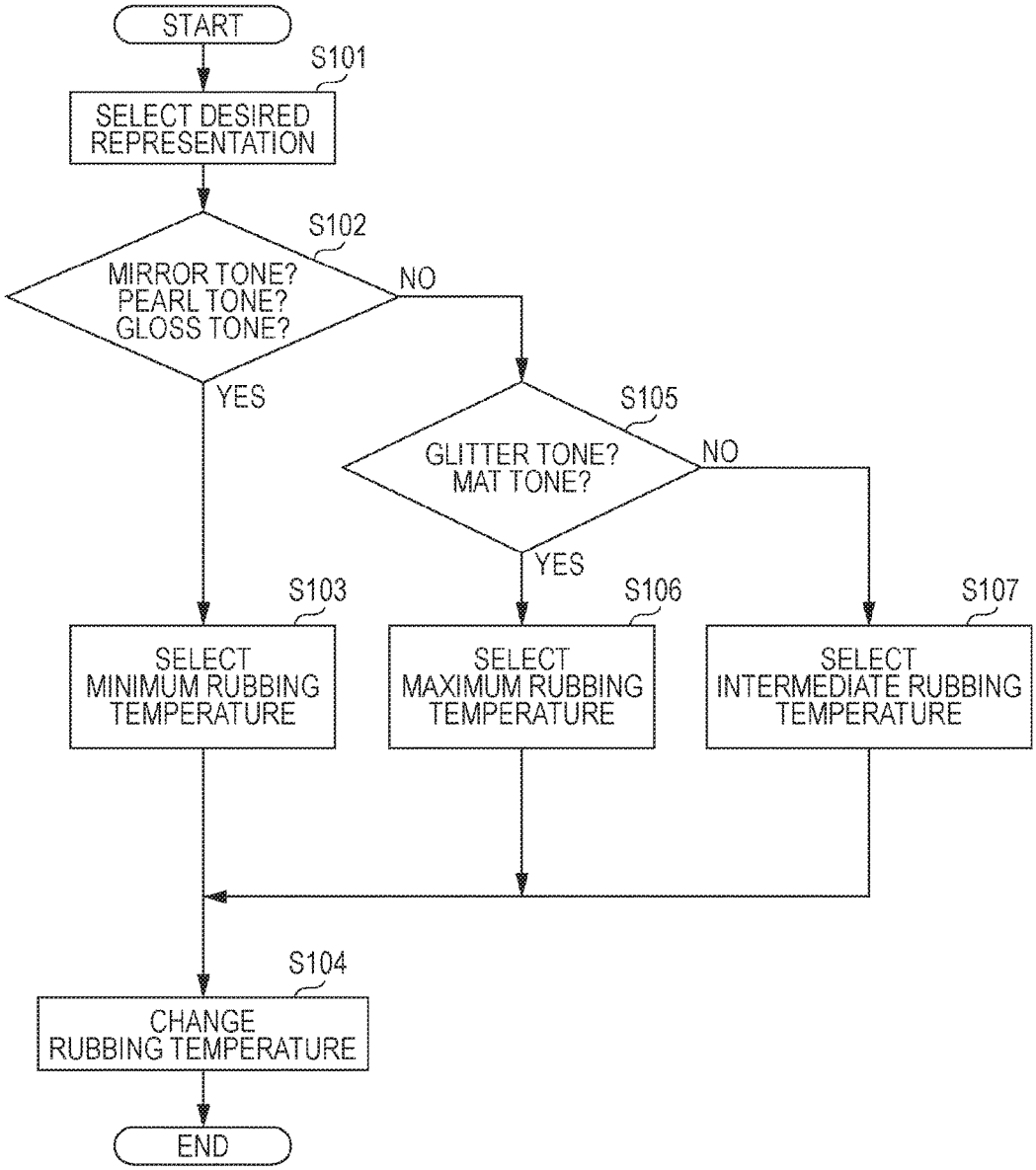
FIG. 4 is a flowchart illustrating an example of control of the image forming apparatus.

The resin image 100 on the paper S is heated from a rear surface of the paper S by the heater 75. For example, as illustrated in FIG. 4, when desired representation of the final image is selected, for example, by an operator (step 101), the above control unit determines whether the input desired representation is the mirror tone, the pearl tone, or the gloss tone (step 102). In a case where the above representation is input, the control unit selects the minimum rubbing temperature (step 103) and controls the output of the heater 75 to adjust the rubbing temperature to the minimum rubbing temperature (step 104).

In a case where the input representation is not the mirror tone, the pearl tone, or the gloss tone, the above control unit determines whether the representation is the glitter tone or the mat tone (step 105). In a case where the above representation is input, the above control unit selects the maximum rubbing temperature (step 106) and controls the output of the heater 75 to adjust the rubbing temperature to the maximum rubbing temperature (step 104).

When the input representation is neither the glitter tone nor the mat tone, the above control unit selects the intermediate rubbing temperature (step 107) and controls the output of the heater 75 to adjust the rubbing temperature to the intermediate rubbing temperature (step 104).

By the heating by the heater 75, the temperature of the resin image 100 is adjusted to the desired rubbing temperature. For example, the temperature of the resin image 100 is adjusted to the minimum rubbing temperature by the above control, the resin image 100 is moderately softened, and adhesion is generated on the surface of the resin image 100.

The rubbing roller 74 is biased toward the paper S and rotates in a direction of an arrow in the drawing. The rubbing roller 74 rotates in a direction opposite to the conveying direction of the paper S. The rubbing roller 74 rotates while pressing the powder 200 on the resin image 100 with appropriate pressing force (for example, approximately 10 kPa), so that the surface of the rubbing roller 74 rubs the surface of the resin image 100 to which the powder 200 is supplied. Since the surface of the resin image 100 has adherence properties, supplied with the powder 200, and is rubbed by the rubbing roller 74, on the surface of the resin image 100, the powder 200 is arrayed in the direction along the surface to be adhered.

More specifically, as illustrated in FIG. 1A, the powder 200 is not oriented in the state in which this is supplied to the surface of the resin image 100. However, the powder 200 has the flat particle shape. Therefore, this is easily arrayed along a plane including a long axis and a short axis (plane orthogonal to a thickness direction). In addition, the powder 200 on the resin image 100 is rubbed while being moderately pressed by the rubbing roller 74. A portion which is not directly in contact with the resin image 100 is removed from the surface of the resin image 100 by the rubbing of the rubbing roller 74. Therefore, as illustrated in FIG. 1B, the powder 200 is arrayed on the surface to adhere along the surface of the resin image 100.

In a case where the intermediate rubbing temperature is selected at step 107 in FIG. 4, the resin image 100 at the time of rubbing is more softened. Therefore, a part of the powder 200 is pushed into the resin image 100 at the time of rubbing. Therefore, as illustrated in FIG. 1C, for example, a part of the powder 200 is arranged along the surface of the resin image 100 and a remaining part thereof is pushed into the resin image 100 in a random orientation.

In a case where the maximum rubbing temperature is selected at step 105 in FIG. 4, the resin image 100 at the time of rubbing is further softened. Therefore, the powder 200 is more easily pushed into the resin image 100 at the time of rubbing. Accordingly, as illustrated in FIG. 1D, the powder 200 is pushed into the resin image 100 in a random direction, for example.

The paper S having the resin image 100 to which the powder 200 is supplied is cooled to room temperature, for example, and the powder 200 is fixed on the resin image 100, and as a result, an image including the paper S, the resin image 100, and the layer of the powder 200 in this order is finally formed.

Meanwhile, out of the powder 200 sprayed on the paper S, the surplus powder 200 present in a portion where no resin image is formed is sucked by the paint powder recovering unit 99 by a flow of air by the paint powder recovering unit 99 to be removed from the paper S, the resin image 100, and the above conveyance path.

In the final image, the presence state of the powder 200 described above according to the rubbing condition is saved. Therefore, for example, in the final image formed at the minimum rubbing temperature, the powder 200 falls on the surface of the resin image 100 by the above rubbing, the planar direction of the powder 200 and the above surface become substantially parallel to each other, and among others, only the powder 200 exhibiting bonding force due to the adherence property of the resin image 100 adheres to the resin image 100 and remains on the above surface.

In this manner, the powder 200 adheres to the surface of the resin image 100 in substantially one layer by the rubbing. The surface of the resin image 100 is not entirely covered with the powder 200. For example, a concealing rate by the aspherical powder 200 on the surface is approximately 60%.

Therefore, in the final image, the mirror-tone, pearl-tone, or gloss-tone appearance is obtained as the appearance in which a visual effect by the layer of the powder 200 and a visual effect of the paper S and the image by the toner layer (underlying image) are combined.

Also, when the powder 200 is used when fabricating the final image obtained by rubbing at the maximum rubbing temperature, a part of or an entire powder 200 is fixed in the state of entering into the resin image 100. Therefore, the final image has the glitter-tone (metallic luster with large diffuse reflection) or mat-tone appearance.

In addition, when the spherical powder (or non-flat powder) is used as the powder 200, an adhesion amount of the powder 200 to the resin image 100 is small at the minimum rubbing temperature. Therefore, the final image substantially has the gloss-tone appearance exhibiting the luster of the resin image 100. In this case, as the rubbing temperature is increased, the amount of powder 200 adhered to the resin image 100 increases. For this reason, the final image has the mat-tone appearance.

The appearance of the final image is controlled by a combination of the shape and appearance of the powder and saturation of the underlying image. For example, in a case where the above powder is the above non-spherical powder having metallic luster, there is a tendency that when the saturation of the underlying image is low, the mirror-tone appearance is exhibited, whereas when the saturation of the underlying image is high, the pearl-tone appearance is exhibited. Also, for example, in a case where the above powder is the above non-spherical powder having the appearance other than the metallic luster, for example, rainbow-color luster, there is a tendency of exhibiting the pearl-tone appearance irrespective of the saturation of the underlying image. In addition, there is a tendency that the glitter-tone appearance is exhibited as the rubbing condition is strengthened.

A boundary value for determining the appearance of the final image of the saturation of the underlying image in a case of using the non-spherical powder of metallic luster might be affected by various conditions such as an image size and a color of a portion adjacent to a portion to which the non-spherical powder adheres on the underlying image, so that it cannot be said unconditionally; however, there is a tendency that the final image has the pearl-tone appearance when the saturation of the underlying image is not smaller 30, and this has the mirror-tone appearance when this is smaller than 30. Meanwhile, the saturation of the underlying image may be measured under the following measurement conditions.

[Measurement Condition]

Measuring device: FD-7 manufactured by Konica Minolta, Inc.

Light source: D50

Background: White Back

Also, in a case where the above powder is colored or transparent spherical powder, there is a tendency that as the adhesion amount of the powder is smaller, the appearance (for example, luster) of the underlying image is represented as it is, and as the adhesion amount of the powder is larger, the mat-tone appearance is exhibited irrespective of color tone of the underlying image.

The desired appearance from the mirror tone and pearl tone to the glitter tone may be determined by an ordinary method and may be determined, for example, by a method of displaying a sensory test result to compare with a reference image by ones skilled in the art as an average value of a score, or by a half value width of a main peak in the reflected light measuring device. The smaller the half value width is, the more the appearance has the mirror tone or the pearl tone, and the larger the half value width is, the more the appearance has the glitter tone.

The desired appearance from the gloss tone to the mat tone may be determined by an ordinary method, for example, the above method utilizing the sensory test result or luster degree measurement.

Meanwhile, in the illustrated embodiment, the above image forming apparatus is integrated with an electrophotographic color printer, but this may also be formed only of the above image forming apparatus. Alternatively, the above image forming apparatus may also be incorporated in the above color printer and formed integrally with the color printer.

As is apparent from the above description, the image forming apparatus of this embodiment is the image forming apparatus for forming the image by arranging the powder on the surface of the resin image formed of the recording medium and the layer of the thermoplastic resin arranged thereon and includes the powder supplying device for supplying the above powder to the surface of the above layer of the above resin image, the control device for setting the rubbing condition of the above resin image according to the image to be formed, and the rubbing device for rubbing the above resin image the temperature of which is adjusted to the temperature equal to or higher than the temperature at which the above layer is softened to which the above powder is supplied from the above layer side according to the above set rubbing condition. The image forming method of this embodiment includes the step of supplying the powder to the surface of the above layer of the resin image formed of the recording medium and the thermoplastic resin layer arranged thereon, the step of setting the rubbing condition of the resin image according to the image to be formed, and the step of rubbing the above resin image of which temperature is adjusted to the temperature at which the above layer is softened or higher to which the above powder is supplied from the above layer side according to the above set rubbing condition. Therefore, according to this embodiment, it is possible to impart the desired appearance from the mirror tone or pearl tone to the glitter tone or from the gloss tone to the mat tone only to the portion of the thermoplastic resin layer, and it is possible to form an image having the desired appearance from the mirror tone or pearl tone to the glitter tone, or from the gloss tone to the mat tone at a desired portion in this manner.

In addition, the fact that the above rubbing device includes the pressing member for pressing the above resin image from the above layer side and the pressing member is configured such that the surface thereof is relatively movable with respect to the surface of the above layer while pressing the above resin image is further effective from a viewpoint of strengthening the bonding force of the above powder to the above layer.

In addition, the fact that the above pressing member is configured so as to be movable in a direction different from the conveying direction of the above resin image which is conveyed, or the above pressing member may reciprocate on the above layer is further effective from a viewpoint of orienting the above powder on the surface of the above layer in one layer.

From a viewpoint of maintenance of the above layer and appropriate orientation of the above non-spherical powder, it is more effective for the above pressing member to have flexibility, and it is further effective that the above pressing member is a sponge.

Also, the fact that the above powder is above non-spherical powder, the non-spherical powder has the flat particle shape, or the shorter diameter of the above non-spherical powder is 0.2 to 3.0 μm is further effective from a viewpoint of controlling the orientation of the powder on the above layer to the preferable orientation.

The fact that the above non-spherical powder is one or both of the metal powder and the metal oxide powder is further effective from a viewpoint of obtaining a clearer appearance of the pearl tone, the mirror tone, or the glitter tone in the final image.

Also, the fact that the above image forming apparatus further includes the temperature adjusting device for adjusting the temperature of the above resin image rubbed by the above rubbing device, or further includes the step of adjusting the temperature of the above rubbed resin image to the temperature at which the above layer softens is further effective from a viewpoint of allowing the non-spherical powder to sufficiently adhere to the surface of the above layer.

Also, the fact that the above image forming apparatus further includes the powder recovery device for recovering the above powder supplied to the surface of the above layer is further effective from a viewpoint of reducing an environmental load in the formation of the final image.

In addition, it is further effective for the above image forming apparatus to further include the image fabricator for fabricating the above resin image from a viewpoint of enhancing the productivity of a high-value added image.

EXAMPLES

[Preparation of Dispersion Fluid for Black Color]

Sodium n-dodecyl sulfate of 11.5 parts by mass was introduced into ion-exchanged water of 160 parts by mass, dissolved and stirred to prepare aqueous surfactant solution. A colorant (carbon black: Mogul L) of 15 parts by mass was gradually added to this aqueous surfactant solution, and "CLEARMIX W Motion CLM-0.8" (manufactured by M Technique Co., Ltd., "CLEARMIX" is the trademark of this company) was used to carry out distribution processing. In this manner, fluid (dispersion fluid for black color) in which fine particles of the black colorant were dispersed was prepared.

A particle diameter of the fine particle of the black colorant in the dispersion fluid for black color was 220 nm in volume-based median diameter. Meanwhile, the volume-based median diameter was determined by measuring by using "MICROTRAC UPA-150" (manufactured by Honeywell Inc.) under the following measurement conditions.

Sample refractive index: 1.59

Sample specific gravity: 1.05 (in terms of spherical particle)

Solvent refractive index: 1.33

Solvent viscosity: 0.797 (30° C.), 1.002 (20° C.)

0 point adjustment: Ion-exchanged water was added to a measurement cell and adjusted.

[Preparation of Dispersion Fluid for Magenta Color]

Fluid (dispersion fluid for magenta color) in which fine particles of magenta colorant were dispersed was prepared in the manner similar to that in the preparation of the dispersion fluid for black color except that "C.I. Pigment Red 122" was used in place of "carbon black: Mogul L".

[Preparation of Dispersion Fluid for White Color]

Fluid (dispersion fluid for white color) in which fine particles of white colorant were dispersed was prepared in the manner similar to that in the preparation of the dispersion fluid for black color except that "SA-1" (manufactured by SAKAI CHEMICAL INDUSTRY CO., LTD.) was used in place of "carbon black: Mogul L".

The median diameter of the fine particles of the magenta colorant in the dispersion fluid for magenta color was 130 nm and the median diameter of the fine particles of the white colorant in the dispersion fluid for white color was 150 nm.

[Fabrication of Resin Particle for Core]

A resin particle for a core having a multilayer structure was fabricated through first stage polymerization, second stage polymerization, and third stage polymerization described below.

(a) First Stage Polymerization

A surfactant aqueous solution 1 obtained by dissolving sodium polyoxyethylene-2-dodecyl ether sulfate of 4 parts by mass in ion-exchanged water of 3040 parts by mass was prepared in a reaction container equipped with a stirring device, a temperature sensor, a cooling tube, and a nitrogen introducing device, and while stirring at a stirring speed of 230 rpm under a nitrogen stream, the temperature of the solution was raised to 80° C.

A polymerization initiator solution 1 prepared by dissolving potassium persulfate of 10 parts by mass in ion-exchanged water of 400 parts by mass was added to the above surfactant aqueous solution 1, the temperature of the obtained mixture solution was raised to 75° C., and then monomer mixture solution 1 containing the following components in the following amounts was added dropwise to the above mixture solution over one hour.

Styrene 532 parts by mass n-butyl acrylate 200 parts by mass

Methacrylic acid 68 parts by mass n-Octyl mercaptan 16.4 parts by mass

After dropping the above monomer mixture solution 1, the obtained reaction fluid was heated and stirred at 75° C. for two hours, whereby polymerization (first stage polymerization) was carried out to fabricate a resin particle A1.

(b) Second Stage Polymerization

Into a flask equipped with a stirring device, monomer mixture solution 2 containing the following components in the following amounts was introduced, and paraffin wax "HNP-57" (manufactured by Nippon Seiro Co., Ltd.) of 93.8 parts by mass as a releasing agent was added and dissolved by heating to 90° C.

Styrene 101.1 parts by mass n-butyl acrylate 62.2 parts by mass

Methacrylic acid 12.3 parts by mass n-octyl mercaptan 1.75 parts by mass

On the other hand, surfactant aqueous solution 2 prepared by dissolving sodium polyoxyethylene-2-dodecyl ether sulfate of 3 parts by mass in ion-exchanged water of 1560 parts by mass was prepared and heated to 98° C. The resin particle A1 of 32.8 parts by mass was added to the aqueous surfactant solution 2, and further the above monomer mixture solution 2 was added, and then mixed and dispersed by a mechanical dispersing machine "CLEARMIX" (manufactured by M Technique Co., Ltd.) having a circulation route for eight hours. By this mixed dispersion, emulsified particle dispersion fluid 1 containing emulsified particles having a dispersed particle diameter of 340 nm was prepared.

Then, polymerization initiator solution 2 obtained by dissolving potassium persulfate of 6 parts by mass in ion-exchanged water of 200 parts by mass was added to the emulsified particle dispersion fluid 1, and the resulting mixture solution was heated and stirred at 98° C. for 12 hours to perform polymerization (second stage polymerization) to fabricate a resin particle A2, and dispersion fluid containing the resin particle A2 was obtained.

(c) Third Stage Polymerization

Polymerization initiator solution 3 prepared by dissolving potassium persulfate of 5.45 parts by mass in ion-exchanged water of 220 parts by mass was added to the dispersion fluid containing the above resin particle A2 and monomer mixture solution 3 containing the following components in the following amount was added dropwise over one hour to the obtained dispersion fluid under a temperature condition of 80° C.

Styrene 293.8 parts by mass n-butyl acrylate 154.1 parts by mass n-octyl mercaptan 7.08 parts by mass After the dropping was finished, polymerization (third stage polymerization) was carried out by heating and stirring for two hours, and after the polymerization was finished it was cooled to 28° C. to fabricate the resin particle for a core.

[Fabrication of Resin Particle for Shell]

A resin particle for a shell was fabricated by performing polymerization reaction and processing after the reaction in the similar manner except that the monomer mixture solution 1 used in the first stage polymerization in the fabrication of the resin particle for a core was changed to the monomer mixture solution 4 containing the following components in the following amounts.

Styrene 624 parts by mass 2-ethylhexyl acrylate 120 parts by mass

Methacrylic acid 56 parts by mass n-Octyl mercaptan 16.4 parts by mass

[Fabrication of Black Toner Particle]

(a) Fabrication of Core Portion

Into a reaction container equipped with a stirring device, a temperature sensor, a cooling pipe, and a nitrogen introducing device, the following components were introduced in the following amounts and stirred. After adjusting the temperature of the resulting mixture solution to 30° C., aqueous sodium hydroxide of 5 mol/liter was added to the mixture solution, and pH thereof was adjusted to 8 to 11.

Resin particles for core 420.7 parts by mass

Ion-exchanged water 900 parts by mass

Dispersion fluid for black color 300 parts by mass

Next, an aqueous solution obtained by dissolving magnesium chloride hexahydrate of 2 parts by mass in ion-exchanged water of 1000 parts by mass was added to the above mixture solution at 30° C. over 10 minutes with stirring. After leaving for three minutes, the temperature of the mixture solution was started to rise, and the above mixture solution was heated to 65° C. over 60 minutes to associate the particles in the mixture solution. In this state, the particle diameter of the associated particle was measured using "Multisizer 3" (manufactured by Coulter), and when the volume-based median diameter of the associated particles reached 5.8 μm, an aqueous solution obtained by dissolving sodium chloride of 40.2 parts by mass in ion-exchanged water of 1000 parts by mass was added to the above mixture solution to stop the association of the particles.

After the association is stopped, furthermore, the liquid temperature was set to 70° C. and heating and stirring were carried out for one hour as aging treatment to continue the fusion of the associated particles to fabricate the core portion. When the average degree of circularity of the core portion was measured with "FPIA 2100" (manufactured by Sysmex Corporation, "FPIA" is the registered trademark of the company), it was 0.912.

(b) Fabrication of Shell

Next, the temperature of the above mixture solution was set to 65° C., the resin particle for a shell of 50 parts by mass was added to the mixture solution, and further, an aqueous solution obtained by dissolving magnesium chloride hexahydrate of 2 parts by mass in ion-exchanged water of 1000 parts by mass was added to the above mixture solution over 10 minutes. Thereafter, the above mixture solution was heated to 70° C. and stirred for one hour. In this manner, the resin particle for a shell was fused to the surface of the core portion, and then the shell was formed by performing the aging treatment at 75° C. for 20 minutes.

Thereafter, an aqueous solution prepared by dissolving sodium chloride of 40.2 parts by mass in ion-exchanged water of 1000 parts by mass was added to stop the formation of the shell. It was further cooled to 30° C. at a rate of 8° C./min. The generated particles were filtered, repeatedly washed with ion-exchanged water at 45° C., and dried with warm air at 40° C., thereby fabricating black toner base particles having the shell covering the surface of the core portion.

(c) External Additive Adding Step

The following external additives were added to the black toner base particles, and an external additive treatment was carried out with "Henschel mixer" manufactured by Nippon Coke & Engineering Co., Ltd.) to fabricate black toner particles.

Hexamethylsilazane-treated silica fine particles 0.6 parts by mass n-octylsilane-treated titanium dioxide fine particles 0.8 parts by mass Meanwhile, the external additive treatment using the Henschel mixer was carried out under the conditions of a peripheral speed of a stirring blade of 35 m/sec, treatment temperature of 35° C., and a treatment time of 15 minutes. The particle diameter of the above silica fine particles of the above external additive was 12 nm in volume-based median diameter and the particle diameter of the above titanium dioxide fine particles was 20 nm in volume-based median diameter.

[Fabrication of Magenta Toner Particle]

A magenta toner particle was fabricated in the manner similar to that in the fabrication of the black toner particle except that dispersion fluid for magenta color was used instead of the dispersion fluid for black color.

[Fabrication of White Toner Particle]

A white toner particle was fabricated in the manner similar to that in the fabrication of the black toner particle except that dispersion fluid for white color was used instead of the dispersion fluid for black color.

[Fabrication of Developer]

Ferrite carrier particles having a volume average particle diameter of 40 μm the surface of which is coated with a copolymer of methyl methacrylate and cyclohexyl methacrylate were mixed to each of the black toner particles and the magenta toner particle in an amount such that toner concentration became 6% by mass, thereby fabricating black developer and magenta developer, respectively.

[Preparation of Recording Media 1 and 2]

The following recording media 1 and 2 were prepared.

Recording medium 1: "New color R Yuki" manufactured by Lintec Corporation

Recording medium 2: "New color R black" manufactured by Lintec Corporation

[Preparation of Powders 1 to 3]

The following powders 1 to 3 were prepared. The powder 1 is the metal powder, and the particle shape thereof is flat. The powder 2 is the resin particle, the particle shape thereof is substantially spherical, and the average degree of circularity thereof is 0.910. The powder 3 is a glass bead, the particle shape thereof is substantially spherical, and the average degree of circularity thereof is 0.992. Each of the powders 1 and 2 is non-spherical powder, and the powder 3 is spherical powder.

Powder 1: "Sunshine Babe D-9 Chrome Powder" manufactured by GG Corporation inc.

Powder 2: White toner particle

Powder 3: Borosilicate glass beads "UBS-0010E" manufactured by Unitika Ltd.

Example 1

The black developer and the recording medium 1 were accommodated in a remodeled machine of "AccurioPress C 2060" (manufactured by Konica Minolta, inc. "AccurioPress" is the registered trademark of the company), and a square patch image of 2 cm×2 cm was formed on the recording medium 1 using the remodeled machine, and the toner image (resin image) having the patch image on the recording medium 1 was output. A portion of the above patch image in the above resin image was in black (black).

The above resin image was placed on a hot plate heated to 85° C. with the above patch image facing upward and the powder 1 was sprayed on the patch image, and the surface of the patch image of the above resin image was rubbed with a sponge roller. The pressing force at the time of rubbing is about 10 kPa. After rubbing, the above resin image was cooled under a room temperature condition, and the remaining powder 1 was removed from the surface of the patch image by a brush. The final image 1-1 was obtained in this manner. The final image 1-1 exhibited the mirror tone (substantial diffuse reflection is not visually recognized and the image is clearly projected).

Reflection measurement for measuring a reflection light (reception light) angle at an incident angle of 20° in the final image 1-1 was performed by using a variable angle photometer "GP-5" manufactured by Murakami Color Research Laboratory Co., Ltd. in a range of the reception light angle of −10 to 50°, and a half-value width of the peak was obtained. The half-value width of the final image 1-1 was 6.6°. Meanwhile, the smaller the above half-value width, the more clear the mirror tone (the image is more clearly projected).

Each of the final images 1-2 to 1-4 was obtained in the manner similar to that of the fabrication of the final image 1-1 except that the temperature of the hot plate was changed to 115° C., 145° C., and 175° C., respectively.

The above half-value width of the final image 1-2 was 10.7°, and the appearance of the final image 1-2 was a glittery mirror tone (slight diffuse reflection is visually recognized but a contour of the projected image is identifiable). The above half-value width of the final image 1-3 was 13.9° and the appearance of the final image 1-3 was a mirror glitter tone (diffuse reflection is visually recognized and presence of the projected image may be identified). The above half-value width of the final image 1-4 was 18.2°, and the appearance of the final image 1-4 was the glitter tone (diffuse reflection is visually recognized and projection of an image is substantially not recognized).

Example 2

Each of the final images 2-1 to 2-4 of the resin image was obtained as in Example 1 except that magenta developer was used in place of the black developer and a patch image in magenta was formed on the recording medium 1 in the resin image.

The half-value width of the final image 2-1 was 6.4°, and the appearance of the final image 2-1 was a magenta pearl tone (luster and uniform turbidity is visually recognized). The half-value width of the final image 2-2 was 10.3°, and the appearance of the final image 2-2 was magenta glittery pearl tone (slightly coarse diffuse reflection is visually recognized in turbidity and luster due to pearl tone). The half-value width of the final image 2-3 was 13.5°, and the appearance of the final image 2-3 was magenta pearly glitter tone (diffuse reflection is visually recognized, and slight turbidity and luster by the pearl tone are recognized). The half-value width of the final image 2-4 was 17.9°, and the appearance of the final image 2-4 was magenta glitter tone (diffuse reflection is visually recognized, and turbidity and luster by the pearl tone are not substantially recognized).

Meanwhile, the peak positions in the reflection measurements of the final images 1-1 to 1-4 and 2-1 to 2-4 were both in the range of 20±2°.

Example 3

Each of the final images 3-1 to 3-4 of the resin image was obtained in the manner similar to that in Example 1 except that the recording medium 2 was used instead of the recording medium 1 and the powder 2 was used instead of the powder 1. Also, the luster degree of each of the final images 3-1 to 3-4 was measured using a luster degree measuring instrument "micro-gloss 75°" manufactured by Tetsutani Co., Ltd. The higher the luster degree, the more glossy the appearance, and the lower the luster degree, the more mat the appearance The luster degree of the final image 3-1 was 72, and the appearance thereof was black gloss tone (visually glossy black). The luster degree of the final image 3-2 was 57, and the appearance thereof was a black mat gloss tone (gloss is visually recognized, but dullness is also recognized). The luster degree of the final image 3-3 was 43, and the appearance thereof was a black glossy mat tone (light and uniform dullness is observed visually). The luster degree of the final image 3-4 was 30, and the appearance thereof was black mat tone (uniform and clear dullness is visually observed and substantially no gloss is observed).

Example 4

Each of final images 4-1 to 4-4 of the resin image was obtained in the manner similar to that in Example 3 except that the powder 3 was used instead of the powder 2. The luster degree of the final image 4-1 was 71, and the appearance thereof was black gloss tone. The luster degree of the final image 4-2 was 54, and the appearance thereof was black mat gloss tone. The luster degree of the final image 4-3 was 39, and the appearance thereof was black glossy mat tone. The luster degree of the final image 4-4 was 23, and the appearance thereof was black mat tone.

Example 5

Each of final images 5-2 to 5-4 was obtained In the manner similar to the fabrication of the final image 4-1 in Example 4 except that the rubbing temperature was set to 85° C. and the pressing force at the time of rubbing was changed to 30 kPa, 50 kPa, and 70 kPa, respectively. The luster degree of the final image 5-2 was 57, and the appearance thereof was black mat gloss tone. The luster degree of the final image 5-3 was 41, and the appearance thereof was black glossy mat tone. The luster degree of the final image 5-4 was 27, and the appearance thereof was black mat tone.

Conditions of image formation and the properties of the final images in the above examples are illustrated in Table 1.

TABLE 1

| | RECORDING MEDIUM No. | COLOR OF DEVELOPER | COLOR OF IMAGE | POWDER No. | FINAL IMAGE No. | PRESSING FORCE (kPa) | RUBBING TEMPERATURE (° C.) | HALF-VALUE WIDTH (°) | LUSTER DEGREE (—) | APPEARANCE |
|---|---|---|---|---|---|---|---|---|---|---|
| EXAMPLE 1 | 1 | BLACK | BLACK | 1 | 1-1 | 10 | 85 | 6.6 | — | MIRROR TONE |
| | | | | | 1-2 | | 115 | 10.7 | — | GLITTERY MIRROR TONE |
| | | | | | 1-3 | | 145 | 13.9 | — | MIRROR GLITTER TONE |
| | | | | | 1-4 | | 175 | 18.2 | — | GLITTER TONE |

TABLE 1-continued

| | RECORD-ING MEDIUM No. | COLOR OF DEVEL-OPER | COLOR OF IMAGE | POW-DER No. | FINAL IMAGE No. | PRESSING FORCE (kPa) | RUBBING TEMPER-ATURE (° C.) | HALF-VALUE WIDTH (°) | LUSTER DEGREE (—) | APPEARANCE |
|---|---|---|---|---|---|---|---|---|---|---|
| EXAMPLE 2 | 1 | MAGENTA | MAGENTA | 1 | 2-1 | 10 | 85 | 6.4 | — | PEARL TONE |
| | | | | | 2-2 | | 115 | 10.3 | — | GLITTERY PARLE TONE |
| | | | | | 2-3 | | 145 | 13.5 | — | PEARLY GLITTER TONE |
| | | | | | 2-4 | | 175 | 17.9 | — | GLITTER TONE |
| EXAMPLE 3 | 2 | BLACK | BLACK | 2 | 3-1 | 10 | 85 | — | 72 | GLOSS TONE |
| | | | | | 3-2 | | 115 | — | 57 | MAT GLOSS TONE |
| | | | | | 3-3 | | 145 | — | 43 | GLOSSY MAT TONE |
| | | | | | 3-4 | | 175 | — | 30 | MAT TONE |
| EXAMPLE 4 | 2 | BLACK | BLACK | 3 | 4-1 | 10 | 85 | — | 71 | GLOSS TONE |
| | | | | | 4-2 | | 115 | — | 54 | MAT GLOSS TONE |
| | | | | | 4-3 | | 145 | — | 39 | GLOSSY MAT TONE |
| | | | | | 4-4 | | 175 | — | 23 | MAT TONE |
| EXAMPLE 5 | 2 | BLACK | BLACK | 3 | 5-2 | 30 | 85 | — | 57 | MAT GLOSS TONE |
| | | | | | 5-3 | 50 | | — | 41 | GLOSSY MAT TONE |
| | | | | | 5-4 | 70 | | — | 27 | MAT TONE |

As is apparent from Table 1, in each of Examples 1 to 5, the final images having the appearances from the mirror tone or pearl tone to the glitter tone or from the gloss tone to the mat tone were obtained. In addition, according to Examples 1 to 5, the appearance of the final image may be adjusted to an arbitrary appearance in a range from the mirror tone or pearl tone to the glitter tone or from the gloss tone to the mat tone depending on the rubbing conditions such as the temperature of the image at the time of rubbing and the pressing force at the time of rubbing.

According to the present invention, an image exhibiting an arbitrary special appearance within a range from the pearl tone or mirror tone to the glitter tone or from the gloss tone to the mat tone in a desired position according to the arrangement of the layer of the thermoplastic resin as the base thereof. The thermoplastic resin layer may be formed by an electrophotographic image forming apparatus. Therefore, according to the present invention, it is expected to further spread the formation of the image exhibiting the above special appearance.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus for forming an image by arranging powder on a resin image formed of a recording medium and a thermoplastic resin layer arranged thereon, the thermoplastic resin layer disposed on a layer side of the resin image, the image forming apparatus comprising:

a powder supplying device that supplies the powder to a surface of the thermoplastic resin layer of the resin image;

a hardware processor that sets a rubbing condition of the resin image in accordance with an image to be formed; and a rubbing device that rubs the layer side of the resin image, which is adjusted to a temperature at which the thermoplastic resin layer is softened or higher, to which the powder is supplied according to the set rubbing condition.

2. The image forming apparatus according to claim 1, wherein the rubbing device includes a pressing member that presses the resin image on the layer side, and the pressing member is configured so that a surface of the pressing member is relatively movable with respect to the surface of the thermoplastic resin layer while pressing the resin image.

3. The image forming apparatus according to claim 2, wherein the pressing member is movable in a direction different from a conveying direction of the resin image being conveyed.

4. The image forming apparatus according to claim 2, wherein the pressing member may reciprocate on the thermoplastic resin layer.

5. The image forming apparatus according to claim 2, wherein the pressing member has flexibility.

6. The image forming apparatus according to claim 2, wherein the pressing member is a sponge.

7. The image forming apparatus according to claim 1, wherein the powder is non-spherical powder.

8. The image forming apparatus according to claim 7, wherein the non-spherical powder has a flat particle shape.

9. The image forming apparatus according to claim 7, wherein a shorter diameter of the non-spherical powder is of 0.2 to 3.0 μm.

10. The image forming apparatus according to claim 7, wherein the non-spherical powder is one or both of metal powder and metal oxide powder.

11. The image forming apparatus according to claim 1, further comprising: a temperature adjusting device that adjusts temperature of the resin image rubbed by the rubbing device.

12. The image forming apparatus according to claim 1, further comprising: a powder recovery device that recovers the powder supplied to the surface of the thermoplastic resin layer.

13. The image forming apparatus according to claim 1, further comprising: an image fabricator that fabricates the resin image.

14. An image forming method comprising:

supplying powder to a surface of a thermoplastic resin layer of a resin image formed of a recording medium and the thermoplastic resin layer arranged thereon, the thermoplastic resin layer disposed on a layer side of the resin image;

setting a rubbing condition of the resin image according to an image to be formed; and rubbing the layer side of the resin image, which is adjusted to a temperature at which the thermoplastic resin layer is softened or higher, to which the powder is supplied according to the set rubbing condition.

15. The image forming method according to claim 14, further comprising:

adjusting the temperature of the resin image to be rubbed to temperature at which the layer is softened or higher.

* * * * *